US005437766A

United States Patent [19]

Van Phan et al.

[11] Patent Number: 5,437,766

[45] Date of Patent: * Aug. 1, 1995

[54] MULTI-PLY FACIAL TISSUE PAPER PRODUCT COMPRISING BIODEGRADABLE CHEMICAL SOFTENING COMPOSITIONS AND BINDER MATERIALS

[75] Inventors: Dean Van Phan, West Chester; Paul D. Trokhan, Hamilton, both of Ohio; Stephen R. Kelly, Independence, Ky.; Ward W. Ostendorf, West Chester; Bart S. Hersko, Cincinnati, both of Ohio

[73] Assignee: The Procter & Gamble Company, Cincinnati, Ohio

[ * ] Notice: The portion of the term of this patent subsequent to Nov. 23, 2010 has been disclaimed.

[21] Appl. No.: 141,320

[22] Filed: Oct. 22, 1993

[51] Int. Cl.[6] ..... D21H 27/38

[52] U.S. Cl. ..... 162/127; 162/112; 162/129; 162/130; 162/132; 162/133; 162/141; 162/142; 162/147; 162/149; 162/158; 162/164.3; 162/164.6; 162/168.3; 162/175; 162/177; 162/113

[58] Field of Search ..... 162/111, 112, 113, 127, 162/130, 129, 158, 175, 133, 132, 177, 164.3, 164.6, 168.3, 141, 142, 147, 149

[56] References Cited

U.S. PATENT DOCUMENTS

| | | | |
|---|---|---|---|
| 2,683,087 | 7/1954 | Reynolds, Jr. | 162/158 |
| 2,683,088 | 7/1954 | Reynolds, Jr. | 162/158 |
| 3,301,746 | 1/1967 | Sanford et al. | 162/113 |

(List continued on next page.)

FOREIGN PATENT DOCUMENTS

| | | |
|---|---|---|
| 61-308312 | 7/1988 | Japan . |
| 4-100995 | 4/1992 | Japan . |

OTHER PUBLICATIONS

"Applications of Armak Quaternary Ammonium Salts", Bulletin 76-17, Armak Co., (1977).

*Primary Examiner*—Peter Chin

*Attorney, Agent, or Firm*—Bart S. Hersko; E Kelly Linman; Jacobus C. Rasser

[57] ABSTRACT

Multi-ply facial tissue paper products comprising biodegradable chemical softener compositions and a combination of a wet strength binder, either permanent and/or temporary, and a dry strength binder is disclosed.

The multi-ply facial tissue paper products contain a biodegradable chemical softening composition comprising a mixture of a biodegradable quaternary ammonium compound and a polyhydroxy compound. The multi-ply facial tissue paper products also contain an effective amount of a wet strength binder, either permanent and/or temporary, and a dry strength binder to control linting and/or to offset the loss in tensile strength, if any, resulting from the use of the biodegradable chemical softening compositions. The use of both wet strength binder, either permanent and/or temporary, and dry strength binder also improves the retention of the chemical softening composition in the sheet. This results in improving one or more of the following properties of the multi-ply facial tissue paper product: the flexibility, the slip-stick coefficient of friction, the FFE-Index and the HTR-Texture.

Preferably, the majority of the biodegradable chemical softening compositions will be disposed on the outer layers of the multi-ply facial tissue paper products where they are most effective. In other words, the biodegradable chemical softening compositions and the wet strength binder, either permanent and/or temporary, and the dry strength binder can be selectively distributed within the multi-ply facial tissue paper product to enhance the softness, absorbency, and/or lint resistance of a particular layer or ply.

31 Claims, 2 Drawing Sheets

U.S. PATENT DOCUMENTS

| | | | |
|---|---|---|---|
| 3,554,863 | 1/1971 | Hervey et al. | 162/158 |
| 3,755,220 | 8/1973 | Freimark et al. | 260/17.3 |
| 3,817,827 | 6/1974 | Benz | 162/113 |
| 3,844,880 | 10/1974 | Meisel, Jr et al. | 162/169 |
| 3,974,025 | 8/1976 | Ayers | 162/113 |
| 3,994,771 | 11/1976 | Morgan, Jr. et al. | 162/113 |
| 4,144,122 | 3/1979 | Emanuelsson et al. | 162/158 |
| 4,158,594 | 6/1979 | Becker et al. | 162/112 |
| 4,191,609 | 3/1980 | Trokhan | 162/113 |
| 4,300,981 | 11/1981 | Carstens | 162/109 |
| 4,303,471 | 12/1981 | Laursen | 162/158 |
| 4,351,699 | 9/1982 | Osborn, III | 162/112 |
| 4,377,543 | 3/1983 | Strohbeen et al. | 264/120 |
| 4,425,186 | 1/1984 | May et al. | 162/158 |
| 4,432,833 | 2/1984 | Breese | 162/158 |
| 4,441,962 | 4/1984 | Osborn, III | 162/111 |
| 4,447,294 | 5/1984 | Osborn, III | 162/158 |
| 4,529,480 | 7/1985 | Trokhan | 162/109 |
| 4,637,859 | 1/1987 | Trokhan | 162/109 |
| 4,795,530 | 1/1989 | Soerens et al. | 162/111 |
| 4,853,086 | 8/1989 | Graef | 162/157.6 |
| 4,940,513 | 7/1990 | Spendel | 162/112 |
| 4,959,125 | 9/1990 | Spendel | 162/158 |
| 4,981,557 | 1/1991 | Bjorkquist | 162/168.2 |
| 5,066,414 | 11/1991 | Chang | 252/8.8 |
| 5,217,576 | 6/1993 | Phan | 162/158 |
| 5,223,096 | 6/1993 | Phan et al. | 162/158 |
| 5,240,562 | 8/1993 | Phan et al. | 162/158 |
| 5,262,007 | 11/1993 | Phan et al. | 162/158 |
| 5,264,082 | 11/1993 | Phan et al. | 162/158 |

MULTI-PLY FACIAL TISSUE PAPER PRODUCT COMPRISING BIODEGRADABLE CHEMICAL SOFTENING COMPOSITIONS AND BINDER MATERIALS

This invention relates to multi-ply facial tissue paper products. More particularly, it relates to multi-ply facial tissue paper products comprising biodegradable chemical softener compositions and a combination of wet strength binders, either permanent and/or temporary, and dry strength binders. The treated tissue webs can be used to make soft, absorbent and lint resistant paper products such as facial tissue products.

BACKGROUND OF THE INVENTION

Paper webs or sheets, sometimes called tissue or paper tissue webs or sheets, find extensive use in modern society. Such items as facial and toilet tissues are staple items of commerce. It has long been recognized that four important physical attributes of these products are their strength, their softness, their absorbency, including their absorbency for aqueous systems; and their lint resistance, including their lint resistance when wet. Research and development efforts have been directed to the improvement of each of these attributes without seriously affecting the others as well as to the improvement of two or three attributes simultaneously.

Strength is the ability of the product, and its constituent webs, to maintain physical integrity and to resist tearing, bursting, and shredding under use conditions, particularly when wet.

Softness is the tactile sensation perceived by the consumer as he/she holds a particular product, rubs it across his/her skin, or crumples it within his/her hand. This tactile sensation is provided by a combination of several physical properties. Important physical properties related to softness are generally considered by those skilled in the art to be the stiffness, the surface smoothness and lubricity of the paper web from which the product is made. Stiffness, in turn, is usually considered to be directly dependent on the dry tensile strength of the web and the stiffness of the fibers which make up the web.

Absorbency is the measure of the ability of a product, and its constituent webs, to absorb quantities of liquid, particularly aqueous solutions or dispersions. Overall absorbency as perceived by the consumer is generally considered to be a combination of the total quantity of liquid a given mass of multi-ply facial tissue paper will absorb at saturation as well as the rate at which the mass absorbs the liquid.

Lint resistance is the ability of the fibrous product, and its constituent webs, to bind together under use conditions, including when wet. In other words, the higher the lint resistance is, the lower the propensity of the web to lint will be.

The use of wet strength resins to enhance the strength of a paper web is widely known. For example, Westfelt described a number of such materials and discussed their chemistry in Cellulose Chemistry and Technology, Volume 13, at pages 813–825 (1979). Freimark et al. in U.S. Pat. No. 3,755,220 issued Aug. 28, 1973 mention that certain chemical additives known as debonding agents interfere with the natural fiber-to-fiber bonding that occurs during sheet formation in paper making processes. This reduction in bonding leads to a softer, or less harsh, sheet of paper. Freimark et al. go on to teach the use of wet strength resins in conjunction with the use of debonding agents to off-set the undesirable effects of the debonding agents. These debonding agents do reduce both dry tensile strength and wet tensile strength.

Shaw, in U.S. Pat. No. 3,821,068, issued Jun. 28, 1974, also teaches that chemical debonders can be used to reduce the stiffness, and thus enhance the softness, of a tissue paper web.

Chemical debonding agents have been disclosed in various references such as U.S. Pat. No. 3,554,862, issued to Hervey et al. on Jan. 12, 1971. These materials include quaternary ammonium salts such as cocotrimethylammonium chloride, oleyltrimethylammonium chloride, di(hydrogenated)tallow dimethyl ammonium chloride and stearyltrimethyl ammonium chloride.

Emanuelsson et al., in U.S. Pat. No. 4,144,122, issued Mar. 13, 1979, teach the use of complex quaternary ammonium compounds such as bis(alkoxy(2-hydroxy)-propylene) quaternary ammonium chlorides to soften webs. These authors also attempt to overcome any decrease in absorbency caused by the debonders through the use of nonionic surfactants such as ethylene oxide and propylene oxide adducts of fatty alcohols.

Armak Company, of Chicago, Ill., in their bulletin 76-17 (1977) disclose the use of dimethyl di(hydrogenated)tallow ammonium chloride in combination with fatty acid esters of polyoxyethylene glycols to impart both softness and absorbency to tissue paper webs.

One exemplary result of research directed toward improved paper webs is described in U.S. Pat. No. 3,301,746, issued to Sanford and Sisson on Jan. 31, 1967. Despite the high quality of paper webs made by the process described in this patent, and despite the commercial success of products formed from these webs, research efforts directed to finding improved products have continued.

For example, Becker et al. in U.S. Pat. No. 4,158,594, issued Jan. 19, 1979, describe a method they contend will form a strong, soft, fibrous sheet. More specifically, they teach that the strength of a tissue paper web (which may have been softened by the addition of chemical debonding agents) can be enhanced by adhering, during processing, one surface of the web to a creping surface in a fine patterned arrangement by a bonding material (such as an acrylic latex rubber emulsion, a water soluble resin, or an elastomeric bonding material) which has been adhered to one surface of the web and to the creping surface in the fine patterned arrangement, and creping the web from the creping surface to form a sheet material.

Conventional quaternary ammonium compounds such as the well known dialkyl dimethyl ammonium salts (e.g. ditallow dimethyl ammonium chloride, ditallow dimethyl ammonium methyl sulfate, di(hydrogenated)tallow dimethyl ammonium chloride etc . . . ) are effective chemical debonding agents. However, these quaternary ammonium compounds are hydrophobic and not biodegradable, and can adversely affect the absorbency of the treated paper webs. Applicants have discovered that mixing biodegradable mono- and diester variations of these quaternary ammonium compounds with a polyhydroxy compound (e.g., glycerol, polyglycerols or polyethylene glycols) will enhance both softness and absorbency rate of fibrous cellulose materials.

Unfortunately the use of biodegradable chemical softening compositions comprising a biodegradable quaternary ammonium compound and a polyhydroxy compound can decrease the strength and the lint resistance of the treated paper webs. Applicants have discovered that both strength and lint resistance can be improved through the use of suitable binder materials such as wet and dry strength resins and retention aid resins known in the paper making art.

The present invention is applicable to tissue paper in general, but particularily applicable to multi-ply, multilayered tissue paper products such as those described in U.S. Pat. No. 3,994,771, issued to Morgan Jr. et al. on Nov. 30, 1976, and in U.S. Pat. No. 4,300,981, Carstens, issued Nov. 17, 1981, both of which are incorporated herein by reference.

The multi-ply facial tissue paper products of the present invention contain an effective amount of wet strength binders, either permanent and/or temporary, combined with dry strength binders to control linting and/or to offset the loss in tensile strength, if any, resulting from the use of the biodegradable chemical softening compositions. Unexpectedly, it has been found that the combination of both wet strength binders, either permanent and/or temporary, and dry strength binders improves the retention of the chemical softening composition in the sheet. This results in improved softness of the multi-ply facial tissue paper product. This softness improvement can be further Understood by noting improvement in one or more of the following paper properties: the flexibility, the slip-stick coefficient of friction and/or physiological surface smoothness (see Ampulski et al., 1991 International Paper Physics Conference Proceedings, book 1, page 19–30, incorporated herein by reference). The increased softener retention is accompanied by little or no additional tensile loss versus a tissue paper sheet formed without the combination of binder materials. This maximizes the softening capabilities with minimal additional negative impacts on the product and process.

It is an object of this invention to provide soft, absorbent and lint resistant multi-ply facial tissue paper products.

It is also a further object of this invention to provide a process for making soft, absorbent, lint resistant multi-ply facial tissue paper products.

These and other objects are obtained using the present invention, as will become readily apparent from a reading of the following disclosure.

SUMMARY OF THE INVENTION

The present invention provides soft, absorbent, lint resistant multi-ply facial tissue paper products comprising paper making fibers, biodegradable chemical softening compositions and a combination of wet strength binders, either permanent and/or temporary, and dry strength binders. Briefly, the chemical softening composition comprises a mixture of:

(a) from about 0.01% to about 3.0% of a biodegradable quaternary ammonium compound, preferably having the formula

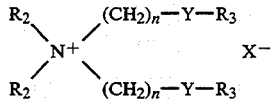

or

-continued

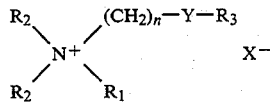

or

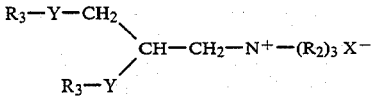

wherein each $R_2$ substituent is a C1–C6 alkyl or hydroxyalkyl group, benzyl group or mixtures thereof; each $R_1$ substituent is a C12–C22 hydrocarbyl group, or substituted hydrocarbyl group or mixtures thereof; each $R_3$ substituent is a C11–C21 hydrocarbyl group, or substituted hydrocarbyl or mixtures thereof; Y is -O-C (O)- or -C(O)-O- or -NH-C (O)- or -C (O)-NH-, and mixtures thereof; n is 1 to 4 and X-is a suitable anion, for example, chloride, bromide, methylsulfate, ethyl sulfate, nitrate and the like; and (b) from about 0.01% to about 3.0% of a water soluble polyhydroxy compound; preferably selected from the group consisting of glycerol, sorbitols, polyglycerols having a weight average molecular weight of from about 150 to about 800 and polyoxyethylene glycols and polyoxypropylene glycols having a weight average molecular weight from about 200 to 1000.

Preferably the weight ratio of the biodegradable quaternary ammonium compound to the polyhydroxy compound ranges from about 1.0:0.1 to 0.1: 1.0. It has been discovered that the biodegradable chemical softening composition is more effective when the polyhydroxy compound is mixed with said biodegradable quaternary ammonium compound at a temperature wherein said biodegradable quaternary ammonium compound and said polyhydroxy compound are miscible.

Examples of preferred ester-functional quaternary ammonium compounds suitable for use in the present invention include compounds having the formulas:

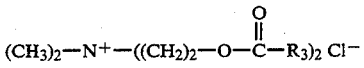

and

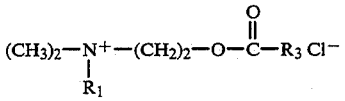

and

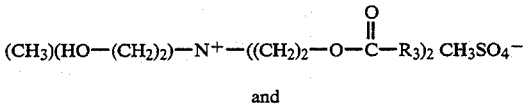

and

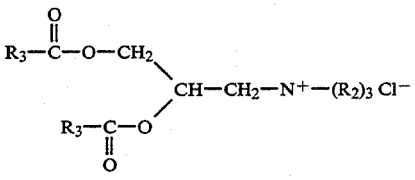

wherein each $R_2$ substituent is a C1–C6 alkyl or hydroxyalkyl group, benzyl group or mixtures thereof; each $R_1$ substituent is a C12–C22 hydrocarbyl group, or substituted hydrocarbyl group or mixtures thereof; each $R_3$ substituent is a C11–C21 hydrocarbyl group, or substituted hydrocarbyl or mixtures thereof.

These compounds can be considered to be mono or diester variations of the well-known dialkyldimethylammonium salts such as diester ditallow dimethyl ammonium chloride, diester distearyl dimethyl ammonium chloride, monoester ditallow dimethyl ammonium chloride, diester di(hydrogenated)tallow dimethyl ammonium methylsulfate, diester di(hydrogenated)tallow dimethyl ammonium chloride, monoester di(hydrogenated)tallow dimethyl ammonium chloride, and mixtures thereof, with the diester variations of di(non hydrogenated)tallow dimethyl ammonium chloride, Di(Touch Hydrogenated)Tallow DiMethyl Ammonium Chloride (DEDTHTDMAC) and Di(Hydrogenated)Tallow DiMethyl Ammonium Chloride (DEDHTDMAC), and mixtures thereof being preferred. Depending upon the product characteristic requirements, the saturation level of the ditallow can be tailored from non hydrogenated (soft) to touch, partially or completely hydrogenated (hard).

Without being bound by theory, it is believed that the ester moiety(ies) lends biodegradability to these compounds. Importantly, the ester-functional quaternary ammonium compounds used herein biodegrade more rapidly than do conventional dialkyl dimethyl ammonium chemical softeners.

Examples of polyhydroxy compounds useful in the present invention include glycerol, polyglycerols having a weight average molecular weight of from about 150 to about 800 and polyoxyethylene glycols having a weight average molecular weight of from about 200 to about 1000, with polyoxyethylene glycols having a weight average molecular weight of from about 200 to about 600 being preferred.

The term binder refers to the various wet and dry strength additives, and retention aids known in the art. These materials improve the lint resistance of the tissue paper webs of the present invention as well as counteracting any decrease in tensile strength caused by biodegradable chemical softening compositions. Examples of suitable binder materials include permanent wet strength binders (i.e. Kymene® 557H marketed by Hercules Incorporated of Wilmington, Del.), temporary wet strength binders: cationic dialdehyde starch-based resins (such as Caldas produced by Japan Carlet or Cobond 1000 produced by National Starch) and dry strength binders (i.e. carboxymethyl cellulose marketed by Hercules Incorporated of Wilmington, Del., and Redibond 5320 marketed by National Starch and Chemical corporation of Bridgewater, N.J).

The multi-ply facial tissue paper products of the present invention preferably comprise from about 0.01% to about 3.0% of a wet strength binder, either permanent and/or temporary, and from about 0.01% to about 3.0% of a dry strength binder.

Without being bound by theory, it is believed that the biodegradable quaternary ammonium softener compounds are effective debonding agents that act to debond the fiber-to-fiber hydrogen bonds in the tissue sheet. The combination of debonding hydrogen bonds with the softener, along with the introduction of chemical bonds with the wet and dry strength binders decreases the overall bond density of the tissue sheet without compromising strength and lint resistance. A reduced bond density will create a more flexible sheet overall, with improved surface softness. Important measures of these physical property changes are the FFE-Index (Carstens) and the bulk flexibility, slip-and-stick coefficient of friction, and physiological surface smoothness as described in Ampulski et al., 1991 International Paper Physics Conference Proceedings, book 1, page 19–30, incorporated herein by reference.

Briefly, the process for making the multi-ply facial tissue paper products of the present invention comprises the steps of formation of a single-layered or multi-layered paper making furnish from the aforementioned components, deposition of the paper making furnish onto a foraminous surface such as a Fourdrinier wire, and removal of the water from the deposited furnish. The resulting single-layered or multi-layered tissue webs are combined with one or more other tissue webs to form a multi-ply tissue.

All percentages, ratios and proportions herein are by weight unless otherwise specified.

BRIEF DESCRIPTION OF THE DRAWINGS

While the Specification concludes with claims particularly pointing out and distinctly claiming the present invention, it is believed the invention is better understood from the following description taken in conjunction with the associated drawings, in which:

Figure 1:
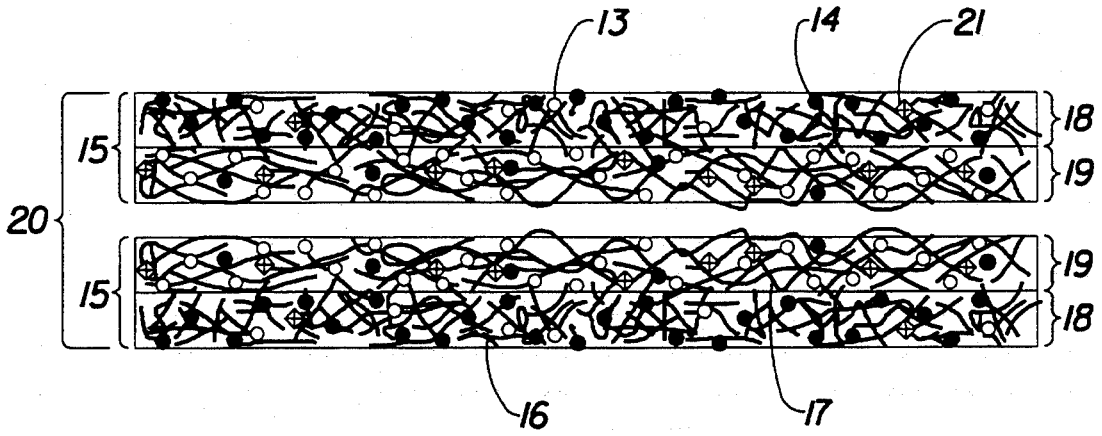
FIG. 1 is a schematic cross-sectional view of a two-ply, two-layered facial tissue in accordance with the present invention.

The present invention is described in more detail below.

DETAILED DESCRIPTION OF THE INVENTION

While this specification concludes with claims particularly pointing out and distinctly claiming the subject matter regarded as the invention, it is believed that the invention can be better understood from a reading of the following detailed description and of the appended examples.

As used herein, the term "lint resistance" is the ability of the fibrous product, and its constituent webs, to bind together under use conditions, including when wet. In other words, the higher the lint resistance is, the lower the propensity of the web to lint will be.

As used herein, the term "binder" refers to the various wet and dry strength resins and retention aid resins known in the paper making art.

As used herein, the term "water soluble" refers to materials that are soluble in water to at least 3% at 25° C.

As used herein, the terms "tissue paper web, paper web, web, paper sheet and paper product" all refer to sheets of paper made by a process comprising the steps of forming an aqueous paper making furnish, depositing this furnish on a foraminous surface, such as a Fourdrinier wire, and removing the water from the furnish as by gravity or vacuum-assisted drainage, with or without pressing, and by evaporation.

As used herein, an "aqueous paper making furnish" is an aqueous slurry of paper making fibers and the chemicals described hereinafter.

As used herein, the term "multi-layered tissue paper web, multi-layered paper web, multi-layered web, multi-layered paper sheet and multi-layered paper product" all refer to sheets of paper prepared from two or more layers of aqueous paper making furnish which are preferably comprised of different fiber types, the fibers typically being relatively long softwood and relatively short hardwood fibers as used in tissue paper making, The layers are preferably formed from the deposition of separate streams of dilute fiber slurries, upon one or more endless foraminous screens. If the individual layers are initially formed on separate wires, the layers are subsequently combined (while wet) to form a layered composite web.

As used herein the term "multi-ply facial tissue paper product" refers to a tissue paper consisting of at least two plies. Each individual ply in turn can consist of single-layered or multi-layered tissue paper webs. The multi-ply structures are formed by bonding together two or more tissue webs such as by glueing or embossing.

The first step in the process of this invention is the forming of an aqueous paper making furnish. The furnish comprises paper making fibers (hereinafter sometimes referred to as wood pulp), and a mixture of at least one quaternary ammonium compound, a polyhydroxy compound and a combination of wet strength binder, permanent and temporary, and a dry strength binder, all of which will be hereinafter described.

It is anticipated that wood pulp in all its varieties will normally comprise the paper making fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used.

Both hardwood pulps and softwood pulps as well as blends of the two may be employed. The terms hardwood pulps as used herein refers to fibrous pulp derived from the woody substance of deciduous trees (angiosperms): wherein softwood pulps are fibrous pulps derived from the woody substance of coniferous trees (gymnosperms). Hardwood pulps such as eucalyptus are particularily suitable for the outer layers of the multi-layered tissue webs described hereinafter, whereas northern softwood Kraft pulps are preferred for the inner layer(s) or ply(s). Also applicable to the present invention are fibers derived from recycled paper, which may contain any or all of the above categories as well as other nonfibrous materials such as fillers and adhesives used to facilitate the original paper making.

Biodegradable Chemical Softener Compositions

The present invention contains as an essential component a mixture of a biodegradable quaternary ammonium compound and a polyhydroxy compound. The ratio of the biodegradable quaternary ammonium compound to the polyhydroxy compound ranges from about 1.0:0.1 to 0.1:1.0; preferably, the weight ratio of the biodegradable quaternary ammonium compound to the polyhydroxy compound is about 1.0:0.3 to 0.3:1.0; more preferably, the weight ratio of the biodegradable quaternary ammonium compound to the polyhydroxy compound is about 1.0:0.7 to 0.7:1.0, although this ratio will vary depending upon the molecular weight of the particular polyhydroxy compound and/or biodegradable quaternary ammonium compound used.

Each of these types of compounds will be described in detail below.

A. Biodegradable Quaternary Ammonium Compound

The biodegradable chemical softening composition contains as an essential component from about 0.01% to about 3.00% by weight, preferably from about 0.01% to about 1.00% by weight of a biodegradable quaternary ammonium compound, preferably biodegradable quaternary ammonium compounds having the formula:

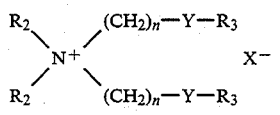

or

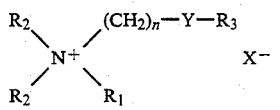

or

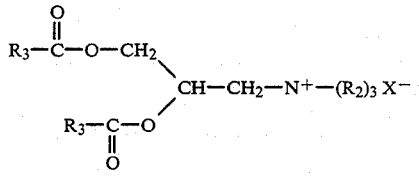

wherein each $R_2$ substituent is a C1–C6 alkyl or hydroxyalkyl group, benzyl group or mixtures thereof; each $R_1$ substituent is a C12–C22 hydrocarbyl group, or substituted hydrocarbyl group or mixtures thereof; each R3 substituent is a C11–C21 hydrocarbyl group, or substituted hydrocarbyl or mixtures thereof; Y is -O-C(O)- or -C(O)-O- or -NH-C(O) or -C(O)-NH- or mixtures thereof; n is 1 to 4 and X-is a suitable anion, for example, chloride, bromide, methylsulfate, ethyl sulfate, nitrate and the like.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft) to touch, partially or completely hydrogenated (hard). All of above-described levels of saturations are expressly meant to be included within the scope of the present invention.

It will be understood that substituents $R_1$, $R_2$ and $R_3$ may optionally be substituted with various groups such as alkoxyl, hydroxyl, or can be branched, but such materials are not preferred herein. Preferably, each $R_1$ is C12–C18 alkyl and/or alkenyl, most preferably each $R_1$ is straight-chain C16–C18 alkyl and/or alkenyl. Preferably, each $R_2$ is methyl or hydroxyethyl. Preferably $R_3$ is C13–C17 alkyl and / or alkenyl, most preferably $R_3$ is straight chain C15–C17 alkyl and/or alkenyl, and X- is chloride or methyl sulfate. Furthermore the ester-functional quaternary ammonium compounds can optionally contain up to about 10% of the mono(long chain alkyl) derivatives, e.g., $(R_2)_2-N^+-((CH_2)_2OH)$ $((CH_2)_2OC(O)R_3)$ X- as minor ingredients. These minor ingredients can act as emulsifiers and are useful in the present invention.

Specific examples of ester-functional quaternary ammonium compounds having the structures named above and suitable for use in the present invention include the well-known diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated)tallow dimethyl ammonium methyl sulfate, diester di(hydrogenated)tallow dimethyl ammonium chloride, and mixtures thereof. Diester ditallow dimethyl ammonium chloride and diester di(hydrogenated)tallow dimethyl ammonium chloride are particularly preferred. These particular materials are available commercially from Witco Chemical Company Inc. of Dublin, Ohio under the tradename "ADOGEN DDMC ®".

Di-quat variations of the ester-functional quaternary ammonium compound can also be used, and are meant to fall within the scope of the present invention. These compounds have the formula:

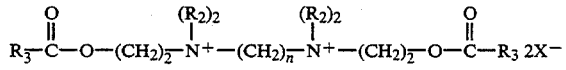

In the structure named above each $R_2$ is a C1–C6 alkyl or hydroxyalkyl group, $R_3$ is C11–C21 hydrocarbyl group, n is 2 to 4 and X- is a suitable anion, such as an halide (e.g., chloride or bromide) or methyl sulfate. Preferably, each $R_3$ is C13–C17 alkyl and/or alkenyl, most preferably each $R_3$ is straight-chain C15–C17 alkyl and/or alkenyl, and $R_2$ is a methyl.

B. Polyhydroxy Compound

The biodegradable chemical softening composition contains as an essential component from about 0.01% to about 3.00% by weight, preferably from about 0.01% to about 1.00% by weight of a water soluble polyhydroxy compound.

Examples of polyhydroxy compounds useful in the present invention include glycerol, polyglycerols having a weight average molecular weight of from about 150 to about 800 and polyoxyethylene glycols and polyoxypropylene glycols having a weight average molecular weight of from about 200 to about 4000, preferably from about 200 to about 1000, most preferably from about 200 to about 600. Polyoxyethylene glycols having an weight average molecular weight of from about 200 to about 600 are especially preferred. Mixtures of the above-described polyhydroxy compounds may also be used. For example, mixtures of glycerol and polyoxyethylene glycols having a weight average molecular weight from about 200 to 1000, more preferably from about 200 to 600 are useful in the present invention. Preferably, the weight ratio of glycerol to polyoxyethylene glycol ranges from about 10:1 to 1:10.

A particularly preferred polyhydroxy compound is polyoxyethylene glycol having an weight average molecular weight of about 400. This material is available commercially from the Union Carbide Company of Danbury, Conn. under the tradename "PEG-400".

The biodegradable chemical softening composition described above i.e. mixture of a biodegradable quaternary ammonium compounds and a polyhydroxy compound are preferably diluted to a desired concentration to form a dispersion of the quat and polyhydroxy compounds before being added to the aqueous slurry of paper making fibers, or furnish, in the wet end of the paper making machine at some suitable point ahead of the Fourdrinier wire or sheet forming stage. However, applications of the above described biodegradable chemical softening composition subsequent to formation of a wet tissue web and prior to drying of the web to completion will also provide significant softness, absorbency, and wet strength benefits and are expressly included within the scope of the present invention.

It has been discovered that the biodegradable chemical softening composition is more effective when the biodegradable quaternary ammonium compound and the polyhydroxy compound are first pre-mixed together before being added to the paper making furnish. A preferred method, as will be described in greater detail hereinafter in Example 1, consists of first heating the polyhydroxy compound to a temperature of about 66° C. (150° F.), and then adding the biodegradable quaternary ammonium compound to the hot polyhydroxy compound to form a homogenous fluid. The weight ratio of the quaternary ammonium compound to the polyhydroxy compound ranges from about 1.0:0.1 to 0.1:1.0; preferably, the weight ratio of the biodegradable quaternary ammonium compound to the polyhydroxy compound is about 1.0:0.3 to 0.3:1.0; more preferably, the weight ratio of the biodegradable quaternary ammonium compound to the polyhydroxy compound is about 1.0:0.7 to 0.7:1.0, although this ratio will vary depending upon the molecular weight of the polyhydroxy compound and/or biodegradable quaternary ammonium compound used.

It has unexpectedly been found that the adsorption of the polyhydroxy compound onto paper is significantly enhanced when it is premixed with the biodegradable quaternary ammonium compound and added to the paper by the above described process.

Importantly, adsorption occurs at a concentration and within a time frame that are practical for use during paper making. In an effort to better understand the surprisingly high retention rate of polyhydroxy compound onto the paper, the physical science of the melted solution and the aqueous dispersion of a Diester Di(-Touch Hardened)Tallow DiMethyl Ammonium Chloride (DEDTHTDMAC), and polyoxyethylene glycol 400 were studied.

Without wishing to be bound by theory, or to otherwise limit the present invention, the following discussion is offered for explaining how the ester-functional quaternary ammonium compound promotes the adsorption of the polyhydroxy compound onto paper.

DEDTHTDMAC (Diester Di(Touch Hardened)-Tallow DiMethyl Ammonium Chloride) exists as a mixture of liquid crystalline and crystalline phases, at equilibrium. X-ray data indicate that commercial DEDTHTDMAC is, in fact, a liquid crystalline phase showing no evidence of crystalline states.

Mixtures of DEDTHTDMAC with PEG-400.

Phase studies of these two materials using the stepwise dilution method demonstrate that their physical behavior is similar to that of di(hydrogenated)tallow dimethyl ammonium chloride. These compounds are miscible over a wide range of temperatures (≧50° C.), which indicates that dispersions may be prepared from these mixtures over a comparable range of temperatures. No upper temperature limit of miscibility exists. The X-ray data show that a mixture of crystal and liquid phases do, in fact, exist in DEDTHTDMAC/PEG-400 mixtures.

Mixtures of DEDTHTDMAC with glycerol.

A 1:1 weight ratio mixture of DEDTHTDMAC and glycerol appears (from direct observation and X-ray data) to be a liquid phase. While glycerol is capable of forming liquid crystal phases in combination with other surfactants, it appears not to do so in this system at this composition.

Mixtures of DEDHTDMAC with PEG-400.

Phase studies of these two materials using the stepwise dilution method demonstrate that their physical behavior is similar to that of DEDTHTDMAC. These compounds are miscible over a wide range of temperatures (>67° C.), which indicates that dispersions may be prepared from these mixtures over a comparable range of temperatures. No upper temperature limit of miscibility exists.

Physical state of mixtures of quats/polyhydroxy compounds/water.

Dispersions of either of these materials may be prepared by diluting a mixture, that is held at a temperature at which the polyhydroxy compound and the ester-functional quaternary ammonium salt are miscible, with water. Neither DEDTHTDMAC nor DEDHTDMAC are soluble in water, so the dilution of either dry phase with water will precipitate the ester-functional quaternary ammonium compound as small particles. The polyhydroxy compound is soluble with water in all proportions, so it is not precipitated.

The addition of mixtures of about equal parts of DEDTHTDMAC and polyhydroxy compounds (e.g. glycerol, PEG-400 etc . . . ) to water, so as to form a mixture containing about 1% of DEDTHTDMAC will precipitate the DEDTHTDMAC. Most likely, the DEDTHTDMAC phase near room temperature will be the lamellar liquid crystal.

Colloidal structure of dispersions.

The liquid crystal phase in the diluted mixtures exists as vesicles which, for the most part, are closed and spherical. The formation of such dispersion likely results from the large osmotic pressure gradients that momentarily exist during the process. The origin of these pressure gradients is the spatial gradients in the composition (and thermodynamic activity) of water that are created. Since the liquid phase of DEDTHTDMAC/glycerol mixtures may exist over a wide range of temperature, one may also produce dispersions over a wide range of temperatures.

Cryoelectron microscopy demonstrates that the particles present are about 0.1 to 1.0 micrometers in size, and highly varied in structure. Some are sheets (curved or flat), while others are closed vesicles. The membranes of all these particles are bilayers of molecular dimensions in which the head groups are exposed to water, the tails are together. The PEG is presumed to be associated with these particles. The application of dispersions prepared in this manner to paper results in attachment of the ester-functional quaternary ammonium ion to the paper, strongly promotes the adsorption of the polyhydroxy compound onto paper, and produces the desired modification of softness and retention of wettability.

State of the dispersions.

When the above described dispersions are cooled, the partial crystallization of the material within the colloidal particles may occur. However, it is likely that the attainment of the equilibrium state will require a long time (perhaps months), so that a disordered particle whose membranes are either a liquid crystal or a disordered crystal phase is interacting with the paper. Preferably, the biodegradable biodegradable chemical softening compositions described herein are used before the equilibrium state has been attained.

It is believed that the vesicles containing biodegradable quats and polyhydroxy compounds (e.g. glycerol, PEG-400 etc . . . ) break apart upon drying of the fibrous cellulosic material. Once the vesicle is broken, the majority of the PEG component may penetrate into the interior of the cellulose fibers where it enhances the fiber flexibility. Importantly, some of the PEG is retained on the surface of the fiber where it acts to enhance the absorbency rate of the cellulose fibers. Due to ionic interaction, the cationic portion of the biodegradable quats component stays on the surface of the cellulose fiber, where it enhances the surface feel and softness of the paper product.

Wet strength binder materials

The present invention contains as an essential component from about 0.01% to about 3.0%, preferably from about 0.01% to about 1.0% by weight of wet strength, either permanent and/or temporary, binder materials.

A. Permanent wet strength binder materials

The permanent wet strength binder materials are chosen from the following group of chemicals: polyamide-epichlorohydrin, polyacrylamides, styrenebutadiene latexes; insolubilized polyvinyl alcohol; urea-formaldehyde; polyethyleneimine; chitosan polymers and mixtures thereof. Preferably the permanent wet strength binder materials are selected from the group consisting of polyamide-epichlorohydrin resins, polyacrylamide resins, and mixtures thereof. The permanent wet strength binder materials act to control linting and also to offset the loss in tensile strength, if any, resulting from the biodegradable chemical softener compositions.

Polyamide-epichlorohydrin resins are cationic wet strength resins which have been found to be of particular utility. Suitable types of such resins are described in U.S. Pat. No. 3,700,623, issued on Oct. 24, 1972, and 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the trade-mark Kymeme ®557H.

Polyacrylamide resins have also been found to be of utility as wet strength resins. These resins are described in U.S. Pat. No. 3,556,932, issued on Jan. 19, 1971, to Coscia, et al. and 3,556,933, issued on Jan. 19, 1971, to Williams et al., both patents being incorporated herein by reference. One commercial source of polyacrylamide resins is American Cyanamid Co. of Stanford, Conn., which markets one such resin under the trademark Parez ®631 N.C.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention.

B. Temporary wet strength binder materials

If temporary wet strength is desired, the binder materials can be chosen from the following group of starch-based temporary wet strength resins: cationic dialdehyde starch-based resin (such as Caldas produced by Japan Carlet or Cobond 1000 produced by National Starch); dialdehyde starch; and/or the resins described in U.S. Pat. No. 4,981,557 issued on Jan. 1, 1991, to Bjorkquist and incorporated herein by reference.

Dry strength binder materials

The present invention contains as an essential component from about 0.01% to about 3.0%, preferably from about 0.01% to about 1.0% by weight of a dry strength binder material chosen from the following group of materials: polyacrylamide (such as combinations of Cypro 514 and Accostrength 711 produced by American Cyanamid of Wayne, N.J.); starch (such as Redibond 5320 and 2005) available from National Starch and Chemical Company, Bridgewater, N.J.; polyvinyl alcohol (such as Airvol 540 produced by Air Products Inc of Allentown, Pa.); guar or locust bean gums; and/or carboxymethyl cellulose (such as CMC from Hercules, Inc. of Wilmington, Del.). Preferably, the dry strength binder materials are selected from the group consisting of carboxymethyl cellulose resins, and unmodified starch based resins and mixtures thereof. The dry strength binder materials act to control linting and also to offset the loss in tensile strength, if any, resulting from the biodegradable chemical softener compositions.

In general, suitable starch for practicing the present Invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca-The Starch from Waxy Corn", H. H. Schopmeyer, Food Industries, December 1945, pp. 106–108 (Vol. pp. 1476–1478). The starch can be in granular or dispersed form albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked". The conditions for dispersion in general can vary depending upon the size of the starch granules, the degree of crystallinity of the granules, and the amount of amylose present. Fully cooked amioca starch, for example, can be prepared by heating an aqueous slurry of about 4X consistency of starch granules at about 190° F. (about 88° C.) for between about 30 and about 40 minutes. Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials are used primarily as a pulp furnish additive to increase wet and/or dry strength. Considering that such modified starch materials are more expensive than unmodified starches, the latter have generally been preferred.

Methods of application include, the same previously described with reference to application of other chemical additives preferably by wet end addition, spraying; and, less preferably, by printing. The binder material may be applied to the tissue paper web alone, simultaneously with, prior to, or subsequent to the addition of the chemical softener composition. At least an effective amount of a combination of wet strength binder, either permanent and/or temporary, and a dry strength binder, preferably a combination of a permanent wet strength resin such as Kymene ®557H and a dry strength resin such as CMC is applied to the sheet, to provide lint control and concomitant strength increase upon drying relative to a non-binder treated but otherwise identical sheet. Preferably, between about 0.01% and about 3.0% of binder materials are retained in the dried sheet, calculated on a dry fiber weight basis; and, more preferably, between about 0.1% and about 1.0% of binder materials is retained.

The second step in the process of this invention is the depositing of the single-layered or multi-layered paper making furnish using the above described chemical softener composition and binder materials as additives on a foraminous surface and the third step is the removing of the water from the furnish so deposited. Techniques and equipment which can be used to accomplish these two processing steps will be readily apparent to those skilled in the paper making art. Preferred multi-layered tissue paper embodiments of the present invention contain from about 0.01% to about 3.0%, more preferably from about 0.1% to 1.0% by weight, on a dry fiber basis of the chemical softening composition and binder materials described herein. The resulting single-layered or multi-layered tissue webs are combined with one or more other tissue webs to form a multi-ply tissue.

The present invention is applicable to multi-ply facial tissue paper in general, including but not limited to conventionally felt-pressed multi-ply facial tissue paper; high bulk pattern densified multi-ply facial tissue paper; and high bulk, uncompacted multi-ply facial tissue paper. The multi-ply facial tissue paper products made therefrom may be of a single-layered or multi-layered construction. Tissue structures formed from layered paper webs are described in U.S. Pat. No. 3,994,771 Morgan Jr. et al. issued Nov. 30, 1976, and incorporated herein by reference. In general, a wet-laid composite, soft, bulky and absorbent paper structure is prepared from two or more layers of furnish which are preferably comprised of different fiber types. The layers are preferably formed from the deposition of separate streams of dilute fiber slurries, the fibers typically being relatively long softwood and relatively short hardwood fibers as used in multilayered tissue paper making, upon one or more endless foraminous screens. If the individual layers are initially formed on separate wires, the layers are subsequently combined (while wet) to form a layered composite web. The layered web is subsequently caused to conform to the surface of an open mesh drying/imprinting fabric by the application of a fluid force to the web and thereafter thermally predried on said fabric as part of a low density paper making process. The layered web may be stratified with respect to fiber type or the fiber content of the respective layers may be essentially the same. The multi-layered tissue paper preferably has a basis weight of between 10 $g/m^2$ and about 65 $g/m^2$, and density of about 0.60 $g/cm^3$ or less. Preferably, basis weight will be below about 35 $g/m^2$ or less; and density will be about 0.30 $g/cm^3$ or less. Most preferably, density will be between 0.04 $g/cm^3$ and about 0.20 $g/cm^3$.

In a preferred embodiment of this invention, tissue structures are formed from multi-layered paper webs as described in U.S. Pat. No. 4,300,981, Carstens, issued Nov. 17, 1981 and incorporated herein by reference. According to Carstens, such paper has a high degree of subjectively perceivable softness by virtue of being: multi-layered; having a top surface layer comprising at least about 60% and preferable about 85% or more of short hardwood fibers; having an HTR (Human Texture Response)-Texture of the top surface layer of about 1.0 or less, and more preferably about 0.7 or less, and most preferably about 0.1 or less; having an FFE (Free Fiber End)-Index of the top surface of about 60 or more, and preferably about 90 or more. The process for making such paper includes the step of breaking sufficient interfiber bonds between the short hardwood fibers defining its top surface to provide sufficient free end portions thereof to achieve the required FFE-Index of the top surface of the tissue paper. Such bond breaking is achieved by dry creping the tissue paper from a creping surface to which the top surface layer (short fiber layer) has been adhesive secured, and the creping should be affected at a consistency (dryness) of at least about 80% and preferably at least about 95% consistency. Such tissue paper may be made through the use of conventional felts, or foraminous carrier fabrics. Such tissue paper may be but is not necessarily of relatively high bulk density.

The individual plies contained in the multi-ply facial tissue paper products of the present invention preferably comprise at least two superposed layers, an inner layer and an outer layer contiguous with the inner layer. The outer layers preferably comprise a primary filamentary constituent of about 60% or more by weight of relatively short paper making fibers having an average fiber between about 0.2 mm and about 1.5 mm. These short paper making fibers are typically hardwood fibers, preferably, eucalyptus fibers. Alternatively, low cost sources of short fibers such as sulfite fibers, thermomechanical pulp, Chemio ThermoMechanical Pulp (CTMP) fibers, recycled fibers, and mixtures thereof can be used in the outer layers or blended in the inner layer, if desired. The inner layer preferably comprises a primary filamentary constituent of about 60% or more by weight of relatively long paper making fibers having an average fiber length of least about 2.0 mm. These long paper making fibers are typically softwood fibers, preferably, northern softwood Kraft fibers.

In a preferred embodiment of the present invention, multi-ply facial tissue paper products are formed by placing at least two multi-layered facial tissue paper webs in juxtaposed relation. For example, a two-layered, two-ply tissue paper product can be made by joining a first two-layered tissue paper web and a second two-layered tissue paper web in juxtaposed relation. In this example, each ply is a two-layer tissue sheet comprising an inner layer and an outer layer. The outer layer preferably comprises the short hardwood fibers and the inner layer preferably comprises the long softwood fibers. The two plies are combined in a manner such that the short hardwood fibers in the outer layers of each ply face outwardly, and the inner layers containing the long softwood fibers face inwardly. In other words, the outer layer of each ply forms one exposed surface of the multiply facial tissue and each of said inner layer of each ply are disposed toward the interior of the facial tissue web.

FIG. 1 is a schematic cross-sectional view of a two-layered two-ply facial tissue in accordance with the present invention. Referring to FIG. 1, the two-layered, two- ply web 20, is comprised of two plies 15 in juxtaposed relation. Each ply 15 is comprised of inner layer 19, and outer layer 18. Outer layers 18 are comprised primarily of short paper making fibers 16; whereas inner layers 19 are comprised primarily of long paper making fibers 17.

Figure 2:
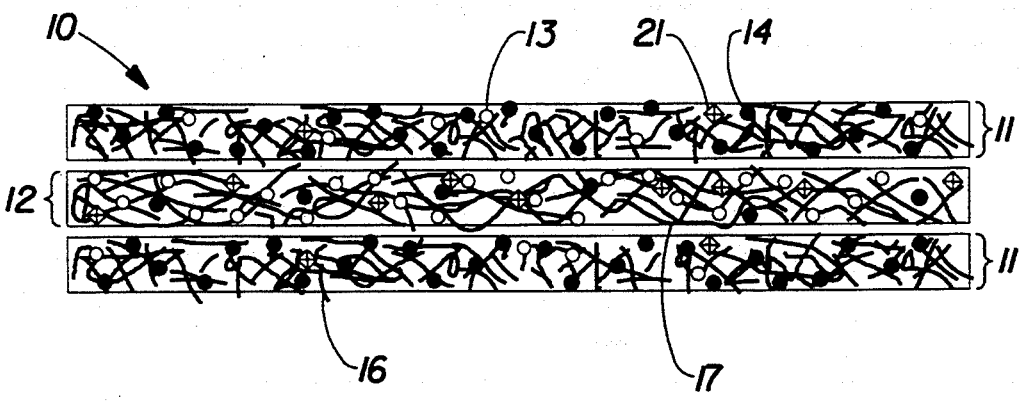
FIG. 2 is a schematic cross-sectional view of a three-ply, single-layered facial tissue in accordance with the present invention.

In an alternate preferred embodiment of the present invention, multi-ply facial tissue paper products are formed by placing three single-layered tissue paper webs in juxtaposed relation. In this example, each ply is a single-layered tissue sheet made of softwood or hardwood fibers. The outer plies preferably comprise the short hardwood fibers and the inner ply preferably comprises long softwood fibers. The three plies are combined in a manner such that the short hardwood fibers face outwardly. FIG. 2 is a schematic cross-sectional view of a single-layered three-ply facial tissue in accordance with the present invention. Referring to FIG. 2, the single-layered three-ply web 10, is comprised of three plies in juxtaposed relation. Two outer plies 11 are comprised primarily of short paper making fibers 16; whereas inner ply 12 is comprised primarily of long paper making fibers 17. In a variation of this embodiment (not shown) each of two outer plies can be comprised of two superposed layers.

It should not be inferred from the above discussion that the present invention is limited to tissue paper products comprising three plies—single layer or two-ply—two layers, etc. All tissue paper products consisting of two or more plies in combination with each ply consisting of one or more layers are also expressly meant to be included within the scope of the present invention.

Preferably, the majority of the biodegradable quaternary ammonium compound and the polyhydroxy compound is contained in at least one of the outer layers (or outer plies of the three-ply, single-layered product) of the multi-ply facial tissue paper product of the present invention. More preferably, the majority of the biodegradable quaternary ammonium compound and the polyhydroxy compound is contained in both of the outer layers or plies. It has been discovered that the biodegradable chemical softening composition is most effective when added to the outer layers or plies of the tissue paper products. There, the mixture of the biodegradable quaternary compound and polyhydroxy compound act to enhance both the softness and the absorbency of the multi-ply tissue products of the present invention. Referring to FIGS. 1 and 2, the biodegradable chemical softening composition comprising a mixture of the biodegradable quaternary ammonium compound and the polyhydroxy compound is schematically represented by dark circles 14. It can be seen in FIGS. 1 and 2 that the majority of the biodegradable chemical softening composition 14 is contained in outer layers 18 and outer plies 11, respectively.

However, it has also been discovered that the lint resistance of the multilayered tissue paper products decreases with the inclusion of the biodegradable quaternary ammonium compound and the polyhydroxy compound. Therefore, binder materials are used for linting control and to increase the tensile strength. Preferably, the binder materials are contained in the inner layers or plies and at least one of the outer layers or plies of the multi-ply facial tissue paper products of the present invention. More preferably, the majority of the binder materials are contained in the inner layers (or inner ply of a three-ply product) of the multi-ply facial tissue paper product. Referring to FIGS. 1 and 2, the permanent and/or temporary wet strength binder materials are schematically represented by white circles 13, the dry strength binder materials are schematically represented by cross-filled diamonds 21. It can be seen in FIGS. 1 and 2 that the majority of the binder materials 13 and 21 are contained in both of the inner layers 19 and inner ply 12, respectively.

The combination of the biodegradable chemical softening composition comprising a biodegradable quaternary ammonium compound and a polyhydroxy compound in conjunction with binder materials results in a tissue paper product having superior softness, absorbency, and lint resistant properties. Selectively adding the majority of the biodegradable chemical softening composition to the outer layers or plys of the tissue paper, enhances its effectiveness. Typically the binder materials are dispersed throughout the tissue sheet to control linting. However, like the chemical softening composition, the binder materials can be selectively added where most needed.

Conventionally pressed multi-layered tissue paper and methods for making such paper are known in the art. Such paper is typically made by depositing paper making furnish on a foraminous forming wire. This forming wire is often referred to in the art as a Fourdrinier wire. Once the furnish is deposited on the forming wire, it is referred to as a web. The web is dewatered by transferring to a dewatering felt, pressing the web and drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dewatered by pressing operations wherein the web is subjected to pressure developed by opposing mechanical members, for example, cylindrical rolls.

The dewatered web is then further pressed during transfer and is dried by a stream drum apparatus known in the art as a Yankee dryer. Pressure can be developed at the Yankee dryer by mechanical means such as an opposing cylindrical drum pressing against the web. Vacuum may also be applied to the web as it is pressed against the Yankee surface. Multiple Yankee dryer drums may be employed, whereby additional pressing is optionally incurred between the drums. The multi-layered tissue paper structures which are formed are referred to hereinafter as conventional, pressed, multi-layered tissue paper structures. Such sheets are considered to be compacted since the entire web is subjected to substantial mechanical compression forces while the fibers are moist and are then dried while in a compressed state.

Pattern densified multi-layered tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987; all of which are incorporated herein by reference.

In general, pattern densified webs are preferably prepared by depositing a paper making furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the multi-layered tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul.

9, 1985, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering can be performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified multi-layered tissue paper structures are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general, uncompacted, non pattern densified multi-layered tissue paper structures are prepared by depositing a paper making furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

The multi-ply facial tissue paper product of this invention can be used in any application where soft, absorbent multi-ply facial tissue paper products are required. Particularly advantageous uses of the multi-ply facial tissue paper product of this invention are in toilet tissue and facial tissue products.

Molecular Weight Determination

A. Introduction

The essential distinguishing characteristic of polymeric materials is their molecular size. The properties which have enabled polymers to be used in a diversity of applications derive almost entirely from their macromolecular nature. In order to characterize fully these materials it is essential to have some means of defining and determining their molecular weights and molecular weight distributions. It is more correct to use the term relative molecular mass rather the molecular weight, but the latter is used more generally in polymer technology. It is not always practical to determine molecular weight distributions. However, this is becoming more common practice using chromatographic techniques. Rather, recourse is made to expressing molecular size in terms of molecular weight averages.

B. Molecular weight averages

If we consider a simple molecular weight distribution which represents the weight fraction ($w_i$) of molecules having relative molecular mass ($M_i$), it is possible to define several useful average values. Averaging carried out on the basis of the number of molecules ($N_i$) of a particular size ($M_i$) gives the Number Average Molecular Weight $$M_n = \frac{\Sigma N_i M_i}{\Sigma Ni}$$

An important consequence of this definition is that the Number Average Molecular Weight in grams contains Avogadro's Number of molecules. This definition of molecular weight is consistent with that of monodisperse molecular species, i.e. molecules having the same molecular weight. Of more significance is the recognition that if the number of molecules in a given mass of a polydisperse polymer can be determined in some way then $\overline{M}_n$, can be calculated readily. This is the basis of colligative property measurements.

Averaging on the basis of the weight fractions ($W_i$) of molecules of a given mass ($M_i$) leads to the definition of Weight Average Molecular Weights $$M_w = \frac{\Sigma W_i N_i}{\Sigma W_i} = \frac{\Sigma N_i M_i^2}{\Sigma N_i M_i}$$

$\overline{M}_w$ is a more useful means for expressing polymer molecular weights than $\overline{M}_n$ since it reflects more accurately such properties as melt viscosity and mechanical properties of polymers and is therefor used in the present invention.

Analytical and Testing Procedures

Analysis of the amount of biodegradable treatment chemicals used herein or retained on tissue paper webs can be performed by any method accepted in the applicable art.

A. Quantitative analysis for ester-functional quaternary ammonium and polyhydroxy compounds For example, the level of the ester-functional quaternary ammonium compound, such as Diester Di(Hydrogenated)Tallow DiMethyl Ammonium Chloride (DEDHTDMAC) (i.e., ADOGEN DDMC®), retained by the tissue paper can be determined by solvent extraction of the DEDHTDMAC by an organic solvent followed by an anionic/cationic titration using Dimidium Bromide as indicator; the level of the polyhydroxy compound, such as PEG-400, can be determined by extraction in an aqueous solvent such as water followed by gas chromatography techniques to determine the level of PEG-400 in the extract. These methods are exemplary, and are not meant to exclude other methods which may be useful for determining levels of particular components retained by the tissue paper.

B. Hydrophilicity (absorbency)

Hydrophilicity of multi-layered tissue paper refers, in general, to the propensity of the multi-layered tissue paper to be wetted with water. Hydrophilicity of multi-layered tissue paper may be somewhat quantified by determining the period of time required for dry multi-layered tissue paper to become completely wetted with water. This period of time is referred to as "wetting time". In order to provide a consistent and repeatable test for wetting time, the following procedure may be used for wetting time determinations: first, a conditioned sample unit sheet (the environmental conditions for testing of paper samples are 23+1° C. and 50+2% R.H. as specified in TAPPI Method T 402), approximately $4\frac{3}{8}$ inch $\times 4\frac{3}{4}$ inch (about 11.1 cm$\times$12 cm) of multi-layered tissue paper structure is provided; second, the sheet is folded into four (4) juxtaposed quarters, and then crumpled into a ball approximately 0.75 inches (about 1.9 cm) to about 1 inch (about 2.5 cm) in diameter; third, the balled sheet is placed on the surface of a body of distilled water at 23±1° C. and a timer is simultaneously started; fourth, the timer is stopped and read when wetting of the balled sheet is completed. Complete wetting is observed visually.

Hydrophilicity characters of multi-layered tissue paper embodiments of the present invention may, of course, be determined immediately after manufacture. However, substantial increases in hydrophobicity may occur during the first two weeks after the multi-layered tissue paper is made: i.e., after the paper has aged two (2) weeks following its manufacture. Thus, the wetting times are preferably measured at the end of such two week period. Accordingly, wetting times measured at the end of a two week aging period at room temperature are referred to as "two week wetting times".

C. Biodegradable

Suitable substantially waterless self-emulsifiable biodegradable chemical softening composition for use in the present invention are biodegradable. As used herein, the term "biodegradability" refers to the complete breakdown of a substance by microorganisms to carbon dioxide, water, biomass, and inorganic materials. The biodegradation potential can be estimated by measuring carbon dioxide evolution and dissolved organic carbon removal from a medium containing the substance being tested as the sole carbon and energy source and a dilute bacterial inoculum obtained from the supernatant of homogenized activated sludge. See Larson, "Estimation of Biodegradation Potential of Xenobiotic Organic Chemicals," *Applied and Environmental Microbiology*, Volume 38 (1979), pages 1153–61, which describes a suitable method for estimating biodegradability. Using this method, a substance is said to be readily biodegradable if it has greater than 70% carbon dioxide evolution and greater than 90% dissolved organic carbon removal within 28 days. The softeners used in the present invention meet such biodegradability criteria.

C. Density

The density of multi-layered tissue paper, as that term is used herein, is the average density calculated as the basis weight of that paper divided by the caliper, with the appropriate unit conversions incorporated therein. Caliper of the multilayered tissue paper, as used herein, is the thickness of the paper when subjected to a compressive load of 95 g/in$^2$ (15.5 g/cm$^2$).

D. Lint

Dry lint

Dry lint can be measured using a Sutherland Rub Tester, a piece of black felt, a four pound weight and a Hunter Color meter. The Sutherland tester is a motor-driven instrument which can stroke a weighted sample back and forth across a stationary sample. The piece of black felt is attached to the four pound weight. The tester then rubs or moves the weighted felt over a stationary issue sample for five strokes. The Hunter Color L value of the black felt is determined before and after rubbing. The difference in the two Hunter Color readings constitutes a measurement of dry linting. Other methods known in the prior arts for measuring dry lint also can be used.

Wet lint

A suitable procedure for measuring the wet linting property of tissue samples is described in U.S. Pat. No. 4,950,545; issued to Walter et al., on Aug. 21, 1990, and incorporated herein by reference. The procedure essentially involves passing a tissue sample through two steel rolls, one of which is partially submerged in a water bath. Lint from the tissue sample is transferred to the steel roll which is moistened by the water bath. The continued rotation of the steel roll deposits the lint into the water bath. The lint is recovered and then counted. See col. 5, line 45-col. 6, line 27 of the Walter et al. patent. Other methods known in the prior art for measuring wet lint also can be used.

Optional Ingredients

Other chemicals commonly used in paper making can be added to the biodegradable chemical softening composition described herein, or to the paper making furnish so long as they do not significantly and adversely affect the softening, absorbency of the fibrous material, and enhancing actions of the biodegradable chemical softening composition.

For example, surfactants may be used to treat the multi-layered tissue paper webs of the present invention. The level of surfactant, if used, is preferably from about 0.01% to about 2.0% by weight, based on the dry fiber weight of the multi-layered tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40 which is available from Croda, Inc. (New York, N.Y.); alkylglycoside ethers as described in U.S. Pat. 4,011,389, issued to W. K. Langdon, et al. on Mar. 8, 1977; and alkylpolyethoxylated esters such as Pegosperse 200 ML available from Glyco Chemicals, Inc. (Greenwich, Conn.) and IGEPAL RC-520 available from Rhone Poulenc Corporation (Cranbury, N.J.).

The above listings of optional chemical additives is intended to be merely exemplary in nature, and are not meant to limit the scope of the invention.

The following examples illustrate the practice of the present invention but are not intended to be limiting thereof.

EXAMPLE 1

The purpose of this example is to illustrate a method that can be used to make-up a substantially waterless self-emulsifiable biodegradable chemical softener composition comprising a mixture of Diester Di(Touch Hardened)Tallow DiMethyl Ammonium Chloride (DEDTHTDMAC) and Polyoxyethylene Glycol 400 (PEG-400).

A waterless self-emulsifiable biodegradable chemical softener composition is prepared according to the following procedure: 1. An equivalent weight of DEDTHTDMAC and PEG-400 is weighed separately; 2. PEG is heated up to about 66° C. (150° F.); 3. DEDTHTDMAC is dissolved in the PEG to form a melted solution at about 66° C. (150° F.); 4. Adequate mixing is provided to form a homogenous mixture of DEDTHTDMAC in PEG; 5. The homogenous mixture of (4) is cooled down to a solid form at room temperature.

The substantially waterless self-emulsifiable biodegradable chemical softener composition of (5) can be pre-mixed (steps 1–5 above) at the chemical supplier (e.g. Witco Corporation of Dublin, Ohio) and then economically shipped to the ultimate users of the biodegradable chemical softening composition where it can then be diluted to the desired concentration.

EXAMPLE 2

The purpose of this example is to illustrate a method that can be used to make-up a substantially waterless self-emulsifiable biodegradable chemical softener composition which comprises a mixture of Diester Di(-Touch Hardened)Tallow DiMethyl Ammonium Chloride (DEDTHTDMAC) and a mixture of Glycerol and PEG-400.

A substantially waterless self-emulsifiable biodegradable chemical softener composition is prepared according to the following procedure: 1. A mixture of Glycerol and PEG-400 is blended at about 75:25 by weight ratio; 2. Equivalent weights of DEDTHTDMAC and the mixture of (1) are weighted separately; 3. Mixture of (1) is heated up to about 66° C. (150° F.); 4. DEDTHTDMAC is dissolved in (3) to form a melted solution at 66° C. (150° F.); 5. Adequate mixing is provided to form a homogenous mixture of DEDTHTDMAC in (3); 6. The homogenous mixture of (5) is cooled down to a solid form at room temperature.

The substantially waterless self-emulsifiable biodegradable chemical softener composition of (6) can be pre-mixed (steps 1–6 above) at the chemical supplier (e.g. Witco Corporation of Dublin, Ohio) and then economically shipped to the ultimate users of the biodegradable chemical softening composition where it can then be diluted to the desired concentration.

EXAMPLE 3

The purpose of this example is to illustrate a method using blow through drying and layered paper making techniques to make soft, absorbent and lint resistant multi-ply facial tissue paper treated with a chemical softener composition comprising Diester Di(Touch Hardened)Tallow DiMethyl Ammonium Chloride (DEDTHTDMAC) and Polyoxyethylene Glycol 400 (PEG-400), a permanent wet strength resin and a dry strength resin.

A pilot scale Fourdrinier paper making machine is used in the practice of the present invention. First, the chemical softener composition is prepared according to the procedure in Example 1 wherein the homogenous premix of DEDTHTDMAC and polyhydroxy compounds in a solid state is re-melted at a temperature of about 66° C. (150° F.). The melted mixture is then dispersed in a conditioned water tank (Temperature ~50° C.; pH ~3) to form a sub-micron vesicle dispersion. The particle size of the vesicle dispersion is determined using an optical microscopic technique. The particle size range is from about 0.1 to 1.0 micron.

Second, a 3% by weight aqueous slurry of northern softwood Kraft fibers is made up in a conventional re-pulper. The NSK slurry is refined gently and a 2% solution of the permanent wet strength resin (i.e. Kymene ®557H marketed by Hercules Incorporated of Wilmington, Del.) is added to the NSK stock pipe at a rate of 0.75% by weight of the dry fibers. The adsorption of the permanent wet strength resin onto NSK fibers is enhanced by an in-line mixer. A 1% solution of the dry strength resin (i.e. CMC from Hercules Incorporated of Wilmington, Del.) is added to the NSK stock before the fan pump at a rate of 0.2% by weight of the dry fibers. The NSK slurry is diluted to about 0.2% consistency at the fan pump.

Third, a 3% by weight aqueous slurry of Eucalyptus fibers is made up in a conventional re-pulper. A 2% solution of the permanent wet strength resin (i.e. Kymene ®557H) is added to the Eucalyptus stock pipe at a rate of 0.2% by weight of the dry fibers, followed by addition of a 1% solution of CMC at a rate of 0.05% by weight of the dry fibers. A 1% solution of the chemical softener mixture is added to the Eucalyptus stock pipe before the in-line mixer at a rate of 0.25% by weight of the dry fibers. The Eucalyptus slurry is diluted to about 0.2% consistency at the fan pump.

Figure 3:
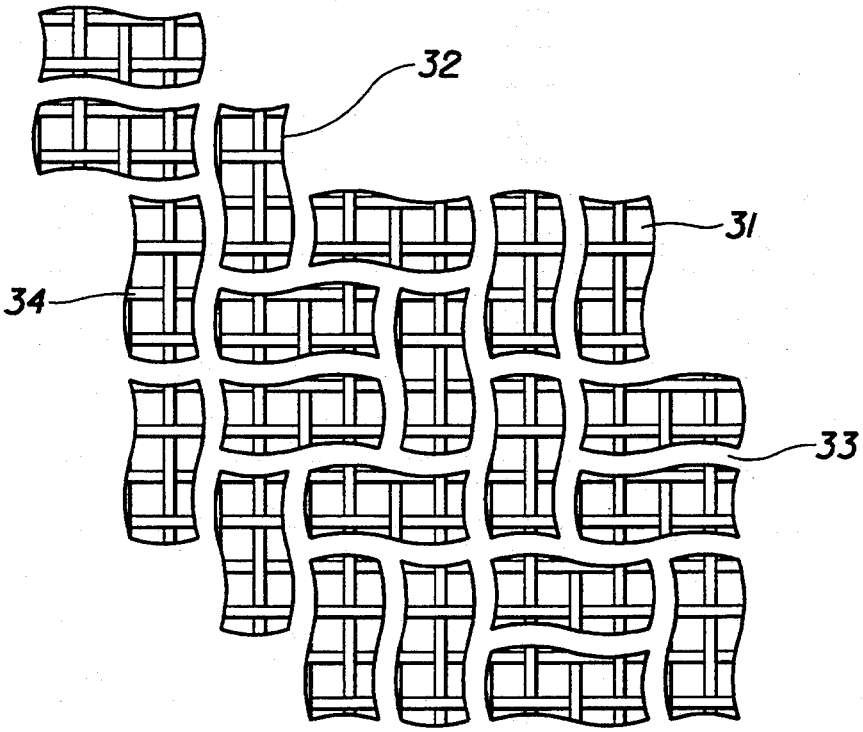
FIG. 3 is a plan view of a random weave pattern unit repeating cell of a preferred photopolymer papermaking belt.

The individually treated furnish streams (stream 1=100% NSK/stream 2=100% Eucalyptus) are kept separate through the headbox and deposited onto a Fourdrinier wire to form a two layer embryonic web containing equal portions of NSK and Eucalyptus. Dewatering occurs through the Fourdrinier wire and is assisted by a deflector and vacuum boxes. The Fourdrinier wire is of a 5-shed, satin weave configuration having 110 machine-direction and 95 cross-machine-direction monofilaments per inch, respectively. The embryonic wet web is transferred from the Fourdrinier wire, at a fiber consistency of about 15% at the point of transfer, to a photo-polymer belt made in accordance with U.S. Pat. No. 4,528,239, Trokhan, issued on Jul. 9, 1985. Referring to FIG. 3, such a belt has 425 discrete deflection conduits 31 per square inch, a repeating random weave pattern 32, 35% photopolymer land area 33 and 5 mils of polymer depth above the woven reinforcing element 34. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 680 fpm (208 meters per minutes).

The web is converted into a two-layer, two-ply facial tissue paper. The multiply facial tissue paper has about 20#/3M Sq. Ft basis weight, contains about 0.475% of the permanent wet strength resin, about 0.125% of the dry strength resin and about 0.125% of the chemical softener mixture. Importantly, the resulting multi-ply tissue paper is soft, absorbent, has good lint resistant and is suitable for use as facial tissues.

EXAMPLE 4

The purpose of this example is to illustrate a method using conventional drying and layered paper making techniques to make soft, absorbent and lint resistant multi-ply facial tissue paper treated with a chemical softener composition comprising Diester Di(Touch Hardened)Tallow DiMethyl Ammonium Chloride (DEDTHTDMAC) and a Polyoxyethylene Glycol 400

(PEG-400), a permanent wet strength resin and a dry strength resin.

A pilot scale Fourdrinier paper making machine is used in the practice of the present invention. First, the chemical softener composition is prepared according to the procedure in Example 2 wherein the homogenous premix of DEDTHTDMAC and polyhydroxy compounds in solid state is re-melted at a temperature of about 66° C. (150° F.). The melted mixture is then dispersed in a conditioned water tank (Temperature ~50° C., pH ~3) to form a sub-micron vesicle dispersion. The particle size of the vesicle dispersion is determined using an optical microscopic technique. The particle size range is from about 0.1 to 1.0 micron.

Second, a 3% by weight aqueous slurry of NSK is made up in a conventional re-pulper. The NSK slurry is refined gently and a 2% solution of the permanent wet strength resin (i.e. Kymene ®557H marketed by Hercules Incorporated of Wilmington, Del.) is added to the NSK stock pipe at a rate of 0.3% by weight of the dry fibers. The adsorption of the permanent wet strength resin onto NSK fibers is enhanced by an in-line mixer. A 1% solution of the dry strength resin (i.e. CMC from Hercules Incorporated of Wilmington, Del.) is added to the NSK stock before the fan pump at a rate of 0.05% by weight of the dry fibers. The NSK slurry is diluted to about 0.2% consistency at the fan pump.

Third, a 3% by weight aqueous slurry of Eucalyptus fibers is made up in a conventional re-pulper. A 2% solution of the permanent wet strength resin (i.e. Kymene ®557H) is added to the Eucalyptus stock pipe at a rate of 0.1% by weight of the dry fibers, followed by addition of a 1% solution of CMC at a rate of 0.025% by weight of the dry fibers. A 1% solution of the chemical softener mixture is added to the Eucalyptus stock pipe before the in-line mixer at a rate of 0.25% by weight of the dry fibers; The Eucalyptus slurry is diluted to about 0.2% consistency at the fan pump.

The individually treated furnish streams (stream 1=100% NSK/stream 2=100% Eucalyptus) are kept separate through the headbox and deposited onto a Fourdrinier wire to form a two layer embryonic web containing equal portions of NSK and Eucalyptus. De-watering occurs through the Fourdrinier wire and is assisted by a deflector and vacuum boxes. The Fourdrinier wire is of a 5-shed, satin weave configuration having 110 machine-direction and 95 cross-machine-direction monofilaments per inch, respectively. The embryonic wet web is transferred from the Fourdrinier wire, at a fiber consistency of about 8% at the point of transfer, to a conventional felt. Further de-watering is accomplished by vacuum assisted drainage until the web has a fiber consistency of about 35%. The web is then adhered to the surface of a Yankee dryer. The fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 650 fpm (200 meters per minutes).

The web is converted into a two-layer, two-ply facial tissue paper. The multiply facial tissue paper has about 18 #/3M Sq. Ft basis weight, contains about 0.2% of the permanent wet strength resin, about 0.0375% of the dry strength resin and about 0.125% of the chemical softener mixture. Importantly, the resulting multi-ply tissue paper is soft, absorbent, has good lint resistance and is suitable for use as facial tissues.

What is claimed is:

1. A multi-ply facial tissue paper product comprising:

a) paper making fibers;

b) from about 0.01% to about 3.0% of a biodegradable quaternary ammonium compound having the formula

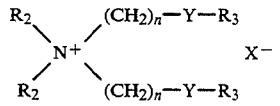

or

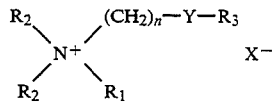

wherein each $R_2$ substituent is a C1–C6 alkyl or hydroxyalkyl group, benzyl group or mixtures thereof; each $R_1$ substituent is a C12–C22 hydrocarbyl group, or substituted hydrocarbyl group or mixtures thereof; each $R_3$ substituent is a C11–C21 hydrocarbyl group, or substituted hydrocarbyl or mixtures thereof; Y is -O-C(O)- or -C(O)-O- or -NH-C(O)- or -C(O)-NH- or mixtures thereof; n is 1 to 4 and $X^-$ is a suitable anion;

c) from about 0.01% to about 3.0% of a water soluble polyhydroxy compound selected from the group consisting of glycerol, polyglycerols having a weight average molecular weight of from about 150 to about 800, polyoxyethylene glycols and polyoxypropylene glycols having a weight average molecular weight from about 200 to 1000, and mixtures thereof;

d) from about 0.01% to about 3.0% of a wet strength binder, either permanent and/or temporary; and e) from about 0.01% to about 3.0% of a dry strength binder; wherein said facial tissue paper product comprises two plies in juxtaposed relation, wherein each of said plies comprises at least two superposed layers, an inner layer and an outer layer contiguous with said inner layer, said plies being oriented in said facial tissue so that said outer layer of each ply forms one exposed surface of said multi-ply facial tissue and each of said inner layers of said plies are disposed toward the interior of said facial tissue paper product, and wherein the majority of the biodegradable quaternary ammonium compound and the polyhydroxy compound is contained in at least one of said outer layers of said plies.

2. The multi-ply facial tissue paper products of claim 1 wherein the majority of the wet strength binders and dry strength binders is contained in at least one of said inner layers.

3. The multi-ply facial tissue paper product of claim 1 wherein the majority of the biodegradable quaternary ammonium compound and the polyhydroxy compound is contained in both of said outer layers.

4. The multi-ply facial tissue paper product of claim 2 wherein the majority of the binders is contained in both of said inner layers.

5. The multi-ply facial tissue paper product of claim 3 wherein the majority of the binders is contained in both of said inner layers.

6. The multi-ply facial tissue paper product of claim 1 wherein each of two said inner layers comprises relatively long paper making fibers having an average length of at least about 2.0 mm and wherein each of two said outer layers comprises relatively short paper making fibers having an average length between about 0.2 mm and about 1.5 mm.

7. The multi-ply facial tissue paper product of claim 6 wherein said inner layers comprise softwood fibers and said outer layers comprise hardwood fibers.

8. The multi-ply facial tissue paper product of claim 7 wherein said softwood fibers are northern softwood Kraft fibers and wherein said hardwood fibers are eucalyptus fibers.

9. The multi-ply facial tissue paper product of claim 6 wherein said inner layers comprises softwood fibers or mixtures of softwood fibers and low cost fibers, and at least one of said outer layers comprises low cost fibers or mixtures of hardwood fibers and low cost fibers.

10. The multi-ply facial tissue paper product of claim 9 wherein said low cost fibers are selected from the group consisting of sulfite fibers, thermomechanical pulp fibers, chemi-thermomechanical pulp fibers, recycled fibers, and mixtures thereof.

11. The multi-ply facial tissue paper product of claim 1 wherein said wet strength binders are permanent wet strength binders selected from the group consisting of polyamide-epichlorohydrin resins, polyacrylamide resins, and mixtures thereof.

12. The multi-ply facial tissue paper product of claim 11 wherein said permanent wet strength binders are polyamide-epichlorohydrin resins.

13. The multi-ply facial tissue paper product of claim 1 wherein said wet strength binders are temporary wet strength binders selected from the group consisting of cationic dialdehyde starch-based resins, dialdehyde starch resins and mixtures thereof.

14. The multi-ply facial tissue paper product of claim 13 wherein said temporary wet strength binders are cationic dialdehyde starch-based resins.

15. The multi-ply facial tissue paper product of claim 1 wherein said dry strength binders are selected from the group consisting of carboxymethyl cellulose resins, starch based resins, and mixtures thereof.

16. The multi-ply facial tissue paper product of claim 15 wherein said dry strength binders are carboxymethyl cellulose resins.

17. The multi-ply facial tissue paper product of claim 1 wherein $R_2$ is methyl, $R_3$ is C15–C17 alkyl or alkenyl and $R_1$ is C16–C18 alkyl or alkenyl.

18. The multi-layered facial tissue paper product of claim 1 wherein Y is -O-C(O)- or -C(O)-O-.

19. The multi-layered facial tissue paper product of claim 1 wherein $X^-$ is chloride or methyl sulfate.

20. The multi-ply facial tissue paper product of claim 1 wherein the weight ratio of the biodegradable quaternary ammonium compound to the polyhydroxy compound ranges from about 1.0:0.1 to about 0.1:1.0.

21. The multi-ply facial tissue paper product of claim 1 wherein the polyhydroxy compound is polyoxyethylene glycols having a weight average molecular weight of from about 200 to about 600.

22. The multi-ply facial tissue paper product of claim 1 wherein said biodegradable quaternary ammonium compound is diester di(touch hardened)tallow dimethyl chloride or methyl sulfate, said polyhydroxy compound is polyoxyethylene glycol having a weight average molecular weight of from about 200 to about 600, said permanent wet strength binder is polyamide-epichlorohydrin resin and said dry strength binder is carboxymethyl cellulose resin, wherein the majority of said biodegradable quaternary ammonium compound and said polyhydroxy compound are contained in both of said outer layers, and wherein the majority of said binder materials is contained in both of said inner layers.

23. The multi-ply facial tissue paper product of claim 1 wherein said facial tissue paper product comprises three plies in juxtaposed relation, two outer plies and one inner ply, said inner ply being located between two said outer plies and wherein each of said three plies comprises a single layer web, wherein the majority of the biodegradable quaternary ammonium compound and the polyhydroxy Compound is contained in two said outer plies, and the majority of said permanent wet strength binders and dry strength binders is located in said inner ply.

24. The multi-ply facial tissue paper product of claim 23 wherein each of said two outer plies comprises two superposed layers.

25. The multi-ply facial tissue paper product of claim 23 wherein said inner ply comprises long softwood fibers and said outer plies comprise short hardwood fibers.

26. The multi-ply facial tissue paper product of claim 23 wherein said biodegradable quaternary ammonium compound is diester di(touch hardened)tallow dimethyl chloride or methyl sulfate, said polyhydroxy compound is polyoxyethylene glycol having a weight average molecular weight of from about 200 to about 600, said permanent wet strength binder is polyamide-epichlorohydrin resin and said dry strength binder is carboxymethyl cellulose resin.

27. The multi-ply facial tissue paper product of claim 24 wherein said biodegradable quaternary ammonium compound is diester di(touch hardened)tallow dimethyl chloride or methyl sulfate, said polyhydroxy compound is polyoxyethylene glycol having a weight average molecular weight of from about 200 to about 600, said permanent wet strength binder is polyamide-epichlorohydrin resin and said dry strength binder is carboxymethyl cellulose resin.

28. A multi-ply facial tissue paper product comprising:

a) paper making fibers;

b) from about 0.01% to about 3.0% of a biodegradable quaternary ammonium compound having the formula

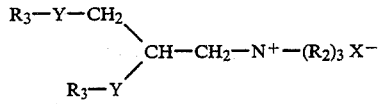

wherein each $R_2$ is a C1–C4 alkyl or hydroxyalkyl group, benzyl group, or mixtures thereof; each $R_3$ is a C11–C21 hydrocarbyl or substituted hydrocarbyl group or mixtures thereof; Y is -O-C(O)- or -C(O)-O- or -NH-C(O) or -C(O)-NH- or mixtures thereof and $X^-$ is a suitable anion;

c) from about 0.01% to about 3.0% of a water soluble polyhydroxy compound selected from the group consisting of glycerol, polyglycerols having a weight average molecular weight of from about 150 to about 800, polyoxyethylene glycols and polyoxypropylene glycols having a weight average molecular weight from about 200 to 1000, and mixtures thereof;

d) from about 0.01% to about 3.0% of a wet strength binder, either permanent and/or temporary; and e) from about 0.01% to about 3.0% of a dry strength binder; wherein said facial tissue paper product comprises two plies in juxtaposed relation, wherein each of said plies comprises at least two superposed layers, an inner layer and an outer layer contiguous with said inner layer, said plies being oriented in said facial tissue so that said outer layer of each ply forms one exposed surface of said multi-ply facial tissue and each of said inner layers of said plies are disposed toward the interior of said facial tissue paper product, and wherein the majority of the quaternary ammonium compound and the polyhydroxy compound is contained in at least one of said outer layers of said plies.

29. The multi-layered facial tissue paper product of claim 28 wherein each $R_2$ is methyl, $R_3$ is C15–C17 alkyl or alkenyl and $R_1$ is C16–C18 alkyl or alkenyl.

30. The multi-layered facial tissue paper product of claim 28 wherein Y is -O-C(O)- or -C(O)-O-.

31. The multi-layered facial tissue paper product of claim 28 wherein X is chloride or methyl sulfate.

* * * * *